US010993537B1

(12) United States Patent
Lujan

(10) Patent No.: US 10,993,537 B1
(45) Date of Patent: May 4, 2021

(54) ROCKING CHAIR BASE WITH PIVOT POINT

(71) Applicant: Carl Lujan, Lahoma, OK (US)

(72) Inventor: Carl Lujan, Lahoma, OK (US)

( * ) Notice: Subject to any disclaimer, the term of this patent is extended or adjusted under 35 U.S.C. 154(b) by 0 days.

(21) Appl. No.: 15/929,354

(22) Filed: Apr. 28, 2020

(51) Int. Cl.
*A47C 3/02* (2006.01)
*A47C 3/029* (2006.01)
*A47C 7/00* (2006.01)

(52) U.S. Cl.
CPC ..... *A47C 3/029* (2013.01); *A47C 7/004* (2013.01)

(58) Field of Classification Search
CPC ..... A47C 3/0255; A47C 3/029; A47C 3/02; A47D 9/02; A47D 13/102; A47D 13/105; A47D 13/10
See application file for complete search history.

(56) References Cited

U.S. PATENT DOCUMENTS 1,834,345 A * 12/1931 Nelson ..... B60B 33/08 297/270.5
2,806,397 A * 9/1957 Nichols, Jr. ..... A47C 3/029 84/95.2
3,890,660 A * 6/1975 Pedler ..... A47D 13/102 5/101
4,807,926 A * 2/1989 Brunn ..... A47C 3/029 297/131
4,919,481 A * 4/1990 Garabedian ..... A47C 3/029 297/271.6
5,560,675 A * 10/1996 Altheimer ..... A47C 3/029 297/258.1
5,833,307 A * 11/1998 Leach ..... A47C 3/029 297/133
7,213,277 B1 * 5/2007 Hsieh ..... A47C 3/029 5/101
7,597,397 B2 * 10/2009 McCoy ..... A47C 3/18 297/259.1
D649,370 S * 11/2011 Mann ..... D6/348
8,083,288 B1 * 12/2011 Warncke ..... A47C 4/02 297/134
9,204,725 B2 * 12/2015 Kania ..... A47C 3/029
10,537,180 B2 * 1/2020 Fletcher ..... A47C 3/12
2009/0085386 A1 * 4/2009 McCoy ..... A47C 3/029 297/258.1
2011/0031783 A1 * 2/2011 Zhong ..... A47D 13/102 297/32
2011/0140492 A1 * 6/2011 Walsh ..... A47C 3/029 297/271.6
2013/0026805 A1 * 1/2013 Sclare ..... A47D 9/02 297/260.2
2018/0271288 A1 * 9/2018 Fletcher ..... A47C 1/02
2020/0016456 A1 * 1/2020 Duke ..... A63B 23/0216

* cited by examiner

*Primary Examiner* — Shin H Kim
(74) *Attorney, Agent, or Firm* — Shannon Warren

(57) ABSTRACT

A pivot rocking chair for comfort and rotation through an orientation axis and a horizontal axis of rotation. wherein. The pivot rocking chair comprises a pivot base, and a chair portion. The pivot base comprises a front portion and a back portion. A single lower support is configured to connect to the pivot base with the chair portion. The pivot base comprises a top surface, a bottom surface, a first side edge, and a second side edge. The pivot base comprises a length and a width. The length comprises a forward rocking portion and a rearward rocking portion.

9 Claims, 9 Drawing Sheets

ROCKING CHAIR BASE WITH PIVOT POINT

CROSS-REFERENCE TO RELATED APPLICATIONS

Not applicable.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant

BRIEF SUMMARY OF THE INVENTION

A pivot rocking chair for comfort and rotation through an orientation axis and a horizontal axis of rotation. wherein. Said pivot rocking chair comprises a pivot base, and a chair portion. Said pivot base comprises a front portion and a back portion. A single lower support is configured to connect to said pivot base with said chair portion. Said pivot base comprises a top surface, a bottom surface, a first side edge, and a second side edge. Said pivot base comprises a length and a width. Said length comprises a forward rocking portion and a rearward rocking portion. Said forward rocking portion is configured to rock on a first convex section and said rearward rocking portion is configured to rock on a second convex section. Said width is substantially similar to said length, thereby said bottom surface is configured to enable a users to selectively press a chosen portion of said bottom surface into a ground surface. Said bottom surface of said pivot base comprises a plurality of pivoting and rocking sections, which comprises a central rounded section, said first convex section, and said second convex section. Said plurality of pivoting and rocking sections are arranged between said front portion and said back portion of said pivot base. Said first convex section is proximate to said front portion and said second convex section is proximate to said back portion. Said pivot base comprises said length and said width. Said length comprises said forward rocking portion and said rearward rocking portion. Said forward rocking portion is configured to rock on said first convex section and said rearward rocking portion is configured to rock on said second convex section. Said width is substantially similar to said length, thereby said bottom surface is configured to enable a users to selectively switch between pivoting and rocking by pressing a chosen portion of said plurality of pivoting and rocking sections into said ground surface. One or more convex sections have a rounded lower surface in cross-section and one or more non-convex section have a substantially flat lower surface in cross-section view.

Said pivot rocking chair for comfort and rotation through said orientation axis and said horizontal axis of rotation. wherein. Said pivot rocking chair comprises said pivot base, and said chair portion. Said pivot base comprises said front portion and said back portion. Said single lower support is configured to connect to said pivot base with said chair portion. Said pivot base comprises said top surface, said bottom surface, said first side edge, and said second side edge.

Said pivot rocking chair for comfort and rotation through said orientation axis and said horizontal axis of rotation. wherein. Said pivot rocking chair comprises said pivot base, and said chair portion. Said pivot base comprises said front portion and said back portion. Said single lower support is configured to connect to said pivot base with said chair portion. Said pivot base comprises said top surface, said bottom surface, said first side edge, and said second side edge. Said pivot rocking chair is configured to rotate forward and back about said horizontal axis of rotation. It is noted that said horizontal axis of rotation is configured to move relative to said pivot rocking chair depending on the shape of said bottom surface as it impacts said ground surface. Said pivot rocking chair comprises a full rocking range of motion, which comprises a rotary measurement between where said front portion and said back portion are in contact with said horizontal axis of rotation. as said pivot rocking chair moves in a rocking motion along said horizontal axis of rotation within said full rocking range of motion, portions of said plurality of pivoting and rocking sections is configured to impact said ground surface. At times, portions of said central rounded section, said first convex section and/or said second convex section will come into contact with said ground surface.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
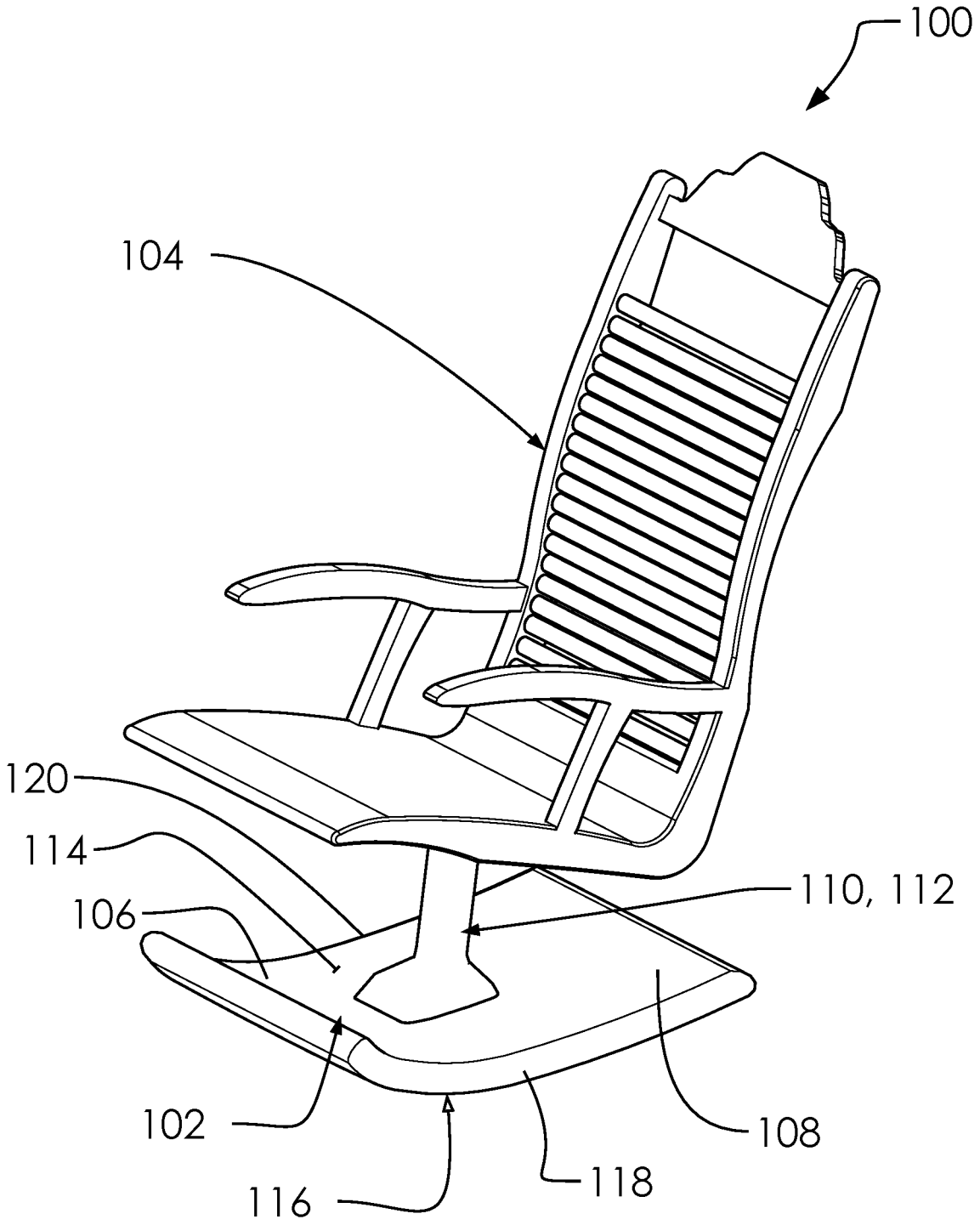
FIG. 1 illustrates a perspective lower view of a pivot rocking chair 100.

FIG. 1 illustrates a perspective lower view of a pivot rocking chair 100.

In one embodiment, said pivot rocking chair 100 can comprise a pivot base 102, and a chair portion 104. Said pivot base 102 can comprise a front portion 106 and a back portion 108.

Said chair portion 104 can connect to said pivot base 102 with one or more lower support 110 (not illustrated), or as here, a single lower support 112.

Said pivot base 102 can comprise a top surface 114, a bottom surface 116, a first side edge 118, and a second side edge 120.

Figure 2:
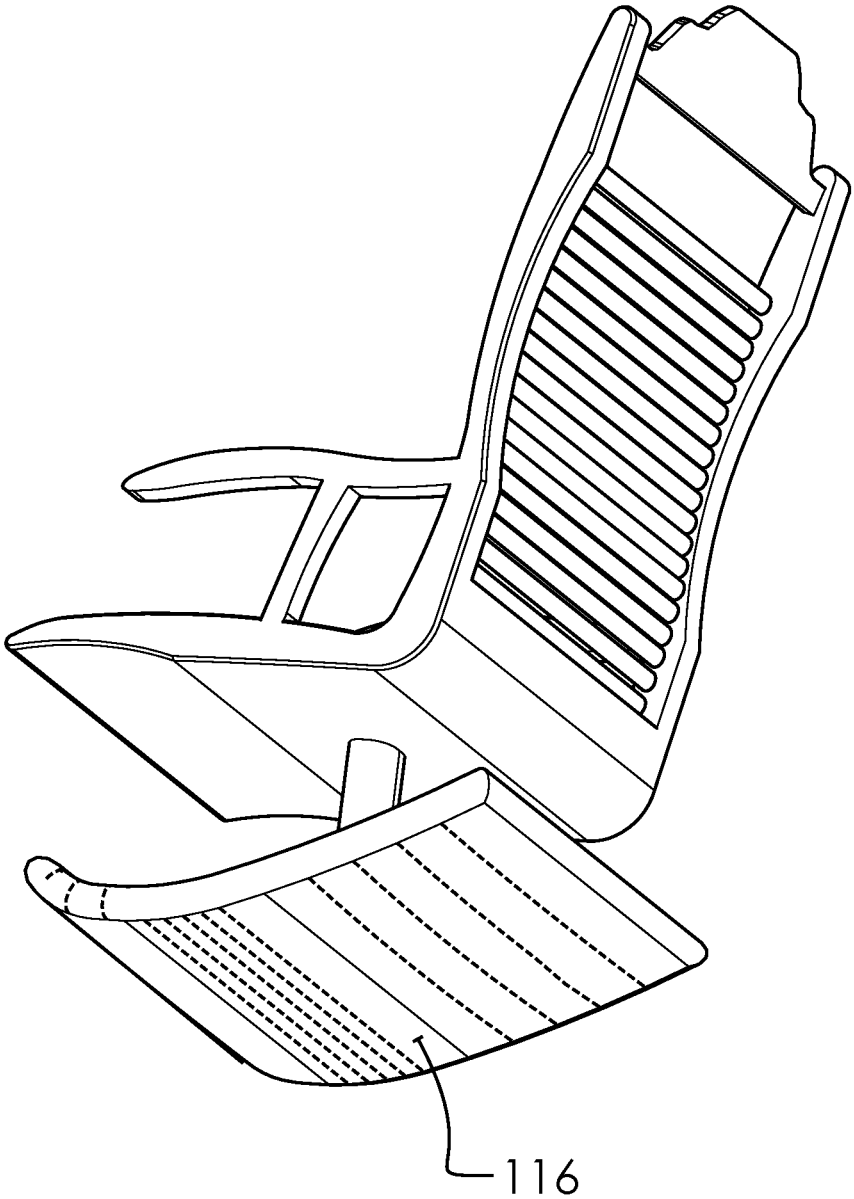
FIG. 2 illustrates a perspective lower view of said pivot rocking chair 100 with hidden lines shown.

FIG. 2 illustrates a perspective lower view of said pivot rocking chair 100 with hidden lines shown.

Figure 3:
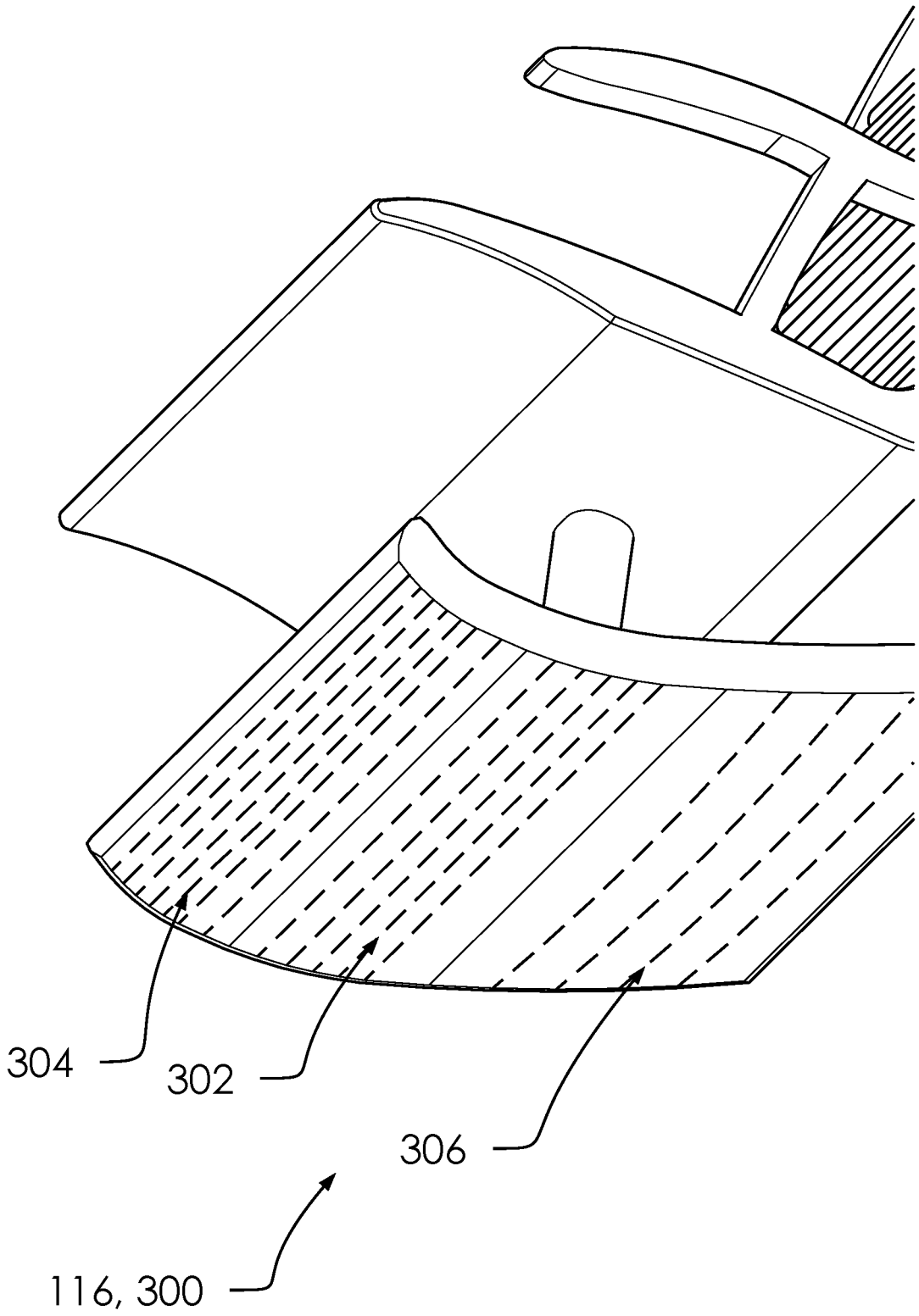
FIG. 3 illustrates a perspective lower view of said pivot rocking chair 100 and a detailed view of a back portion 108.

FIG. 3 illustrates a perspective lower view of said pivot rocking chair 100 and a detailed view of said back portion 108.

Said bottom surface 116 of said pivot base 102 can comprise a plurality of pivoting and rocking sections 300, which can comprise a central rounded section 302, a first convex section 304, and a second convex section 306. Said plurality of pivoting and rocking sections 300 can be arranged between said front portion 106 and said back portion 108 of said pivot base 102. Said first convex section 304 can be proximate to said front portion 106 and said second convex section 306 can be proximate to said back portion 108. Accordingly, said plurality of pivoting and rocking sections 300 can comprise one or more convex sections 308 (said first convex section 304 and said second convex section 306) and one or more non-convex section 310 (said central rounded section 302).

Figure 4A:
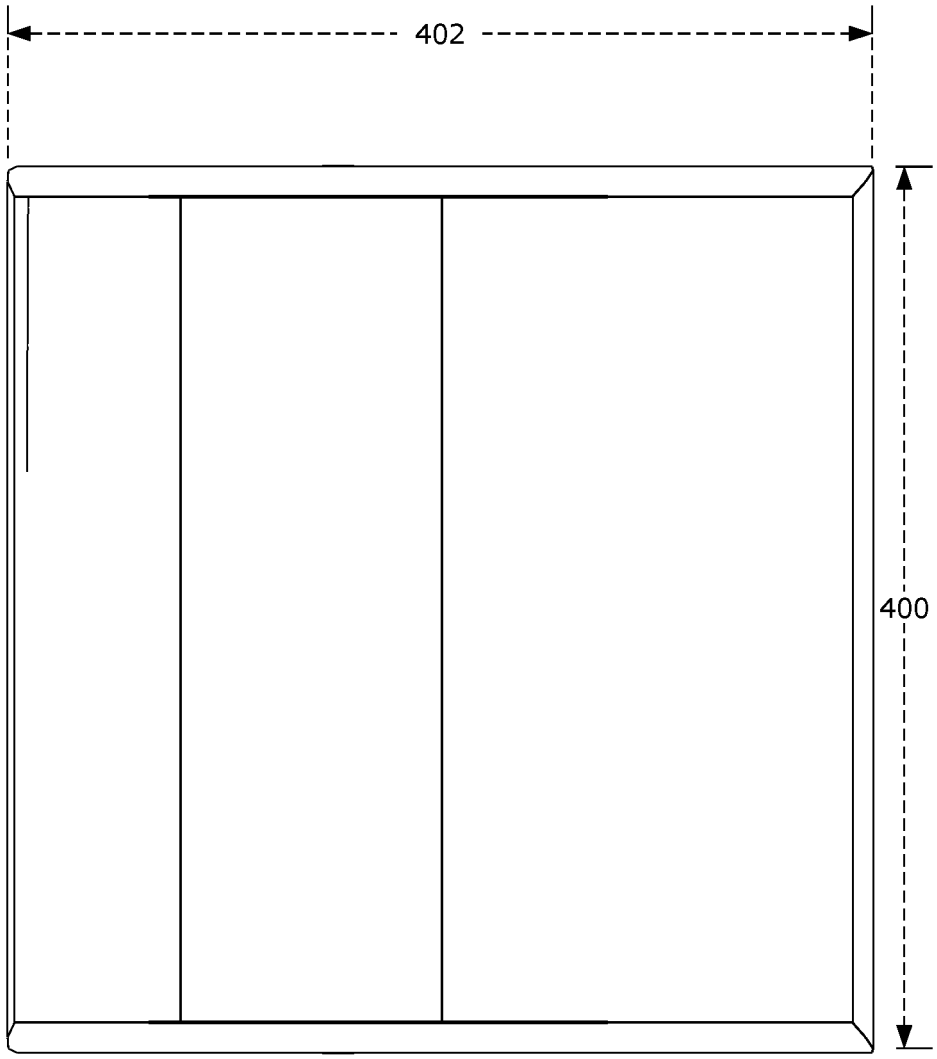
FIGS. 4A and 4B illustrate a side view and an elevated backside view of said pivot rocking chair 100.
Figure 4B:
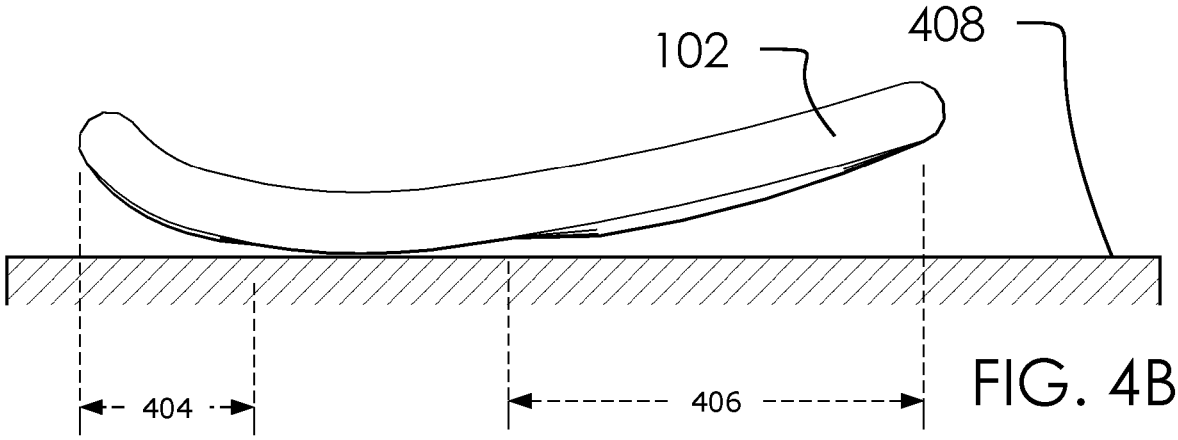

FIGS. 4A and 4B illustrate a side view and an elevated backside view of said pivot rocking chair 100.

Said pivot base 102 can comprise a length 402 and a width 400. In one embodiment, said length 402 can comprise a forward rocking portion 404 and a rearward rocking portion 406. Said forward rocking portion 404 can rock on said first convex section 304 and said rearward rocking portion 406 can rock on said second convex section 306.

Unlike the prior art, said pivot rocking chair 100 can comprise a single base (said pivot base 102) for impacting a ground surface 408 rather than two parallel rocking bases, as is known in the art. Further, by having said width 400 being substantially similar to said length 402, said bottom surface 116 can enable a users to selectively switch between pivoting and rocking by pressing a chosen portion of said plurality of pivoting and rocking sections 300 into said ground surface 408.

Figure 5A:
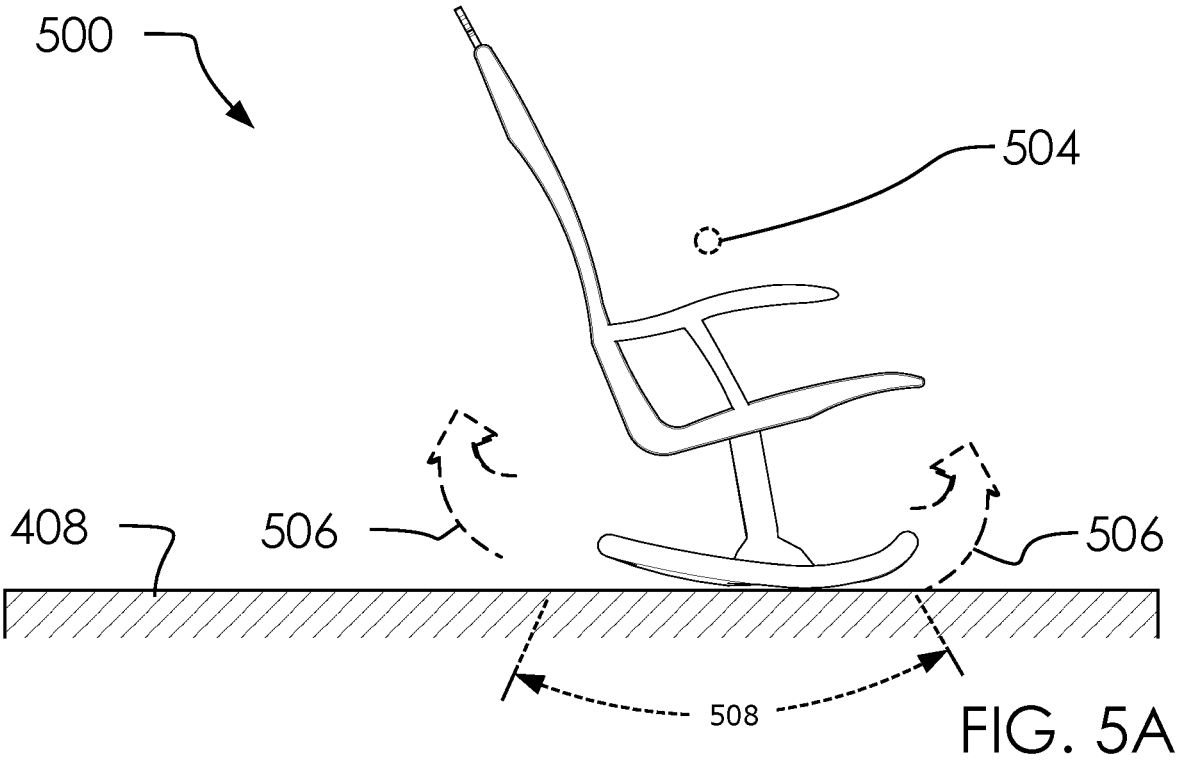
FIGS. 5A, 5B, and 5C illustrate an elevated side view of said pivot rocking chair 100 in a level configuration 500, a rearward rocking configuration 502, and a forward rocking configuration 516.
Figure 5B:
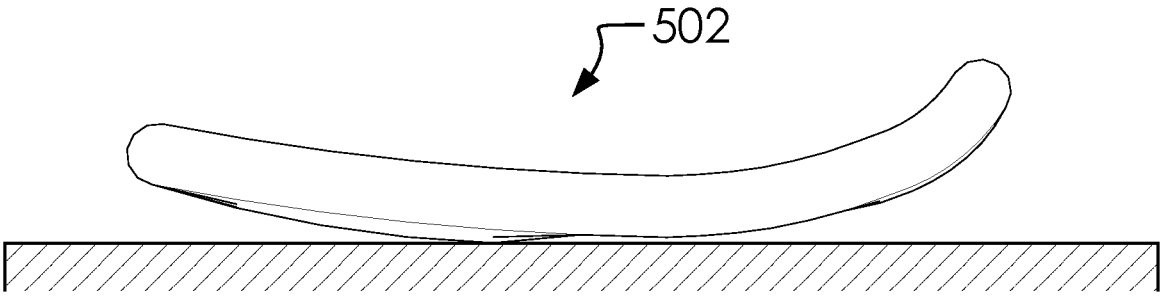
Figure 5C:
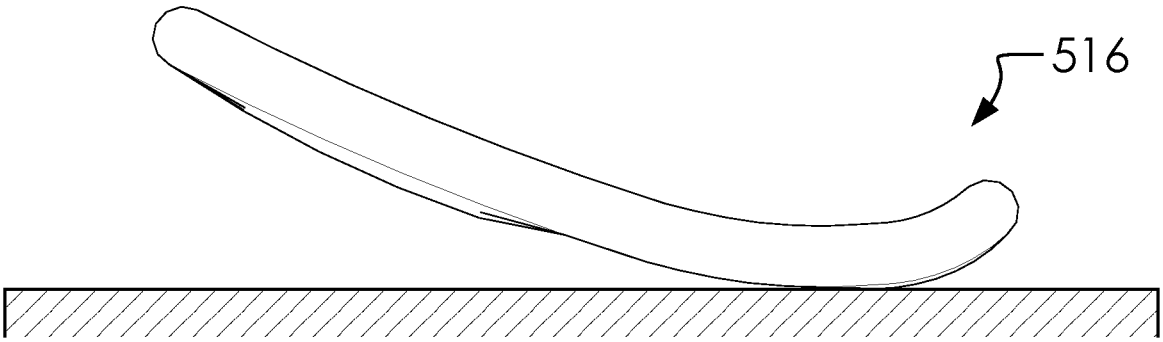

FIGS. 5A, 5B, and 5C illustrate an elevated side view of said pivot rocking chair 100 in a level configuration 500, a rearward rocking configuration 502, and a forward rocking configuration 516.

In one embodiment, said pivot rocking chair 100 can rotate forward and back about a horizontal axis of rotation 504. It is noted that said horizontal axis of rotation 504 can move relative to said pivot rocking chair 100 depending on the shape of said bottom surface 116 as it impacts said ground surface 408.

Said pivot rocking chair 100 can comprise a full rocking range of motion 508, which can comprise a rotary measurement between where said front portion 106 and said back portion 108 are in contact with said horizontal axis of rotation 504.

As said pivot rocking chair 100 moves in a rocking motion 506 along said horizontal axis of rotation 504 within said full rocking range of motion 508, portions of said plurality of pivoting and rocking sections 300 can impact said ground surface 408. At times, portions of said central rounded section 302, said first convex section 304 and/or said second convex section 306 will come into contact with said ground surface 408.

Figure 6A:
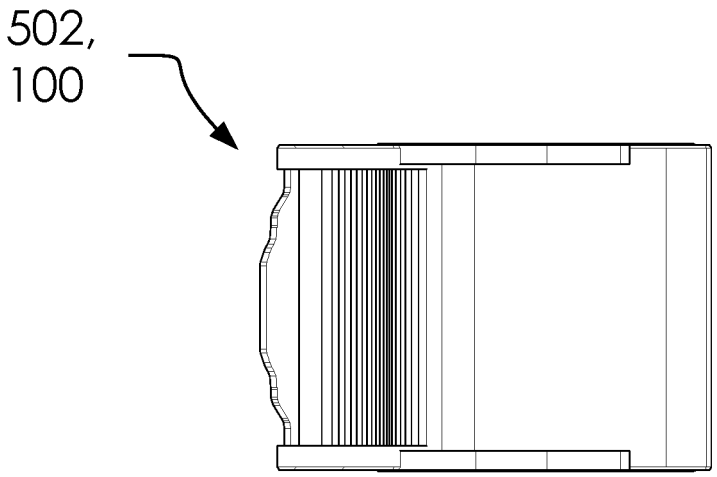
FIGS. 6A and 6B illustrate an elevated top view of said rearward rocking configuration 502 and said pivot rocking chair 100 in a range of pivoted positions 600.
Figure 6B:
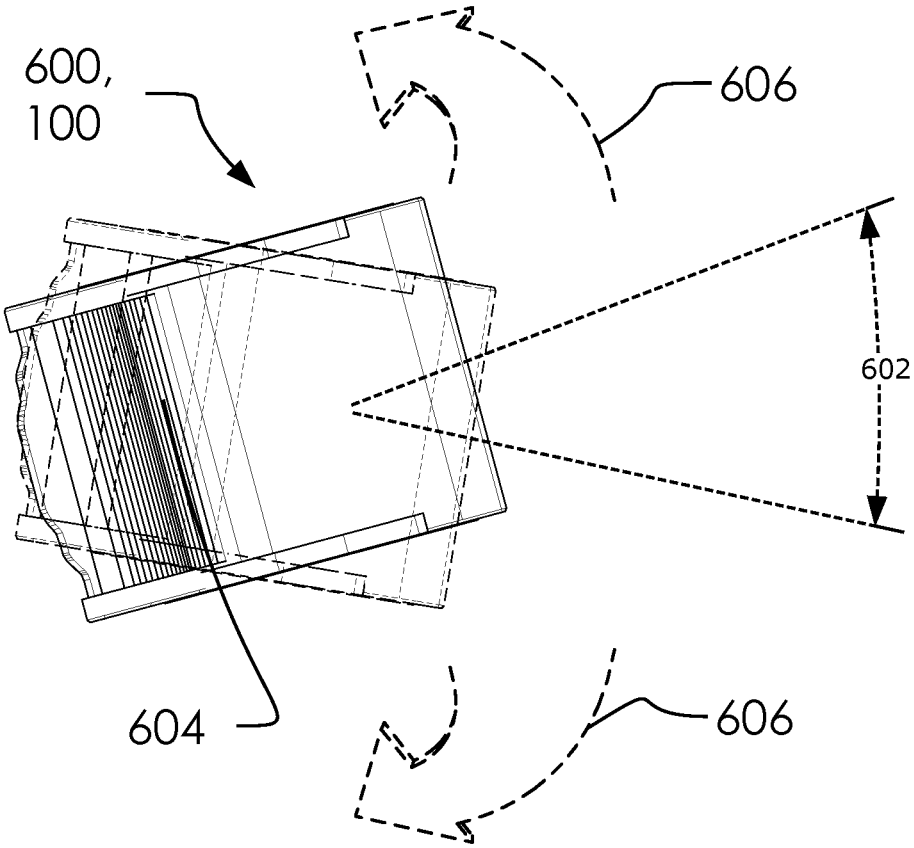

FIGS. 6A and 6B illustrate an elevated top view of said rearward rocking configuration 502 and said pivot rocking chair 100 in a range of pivoted positions 600.

In one embodiment, said pivot rocking chair 100 can rotate on a portion of said bottom surface 116 of said pivot base 102 as said pivot rocking chair 100 moves in said rocking motion 506. In one embodiment, with said bottom surface 116 on either said first convex section 304 or said second convex section 306 in contact with said ground surface 408, said pivot rocking chair 100 can move in an pivoting motion 606 about an orientation axis 604. Said orientation axis 604 can comprise a substantially vertical axis above a place where a portion of a convex surface (such as said first convex section 304 and said second convex section 306) are in contact with contact with said ground surface 408.

As illustrated, said pivot rocking chair 100 can rotate through a change of orientation 602, which can comprise 360 degrees when on said convex surface.

Figure 7A:
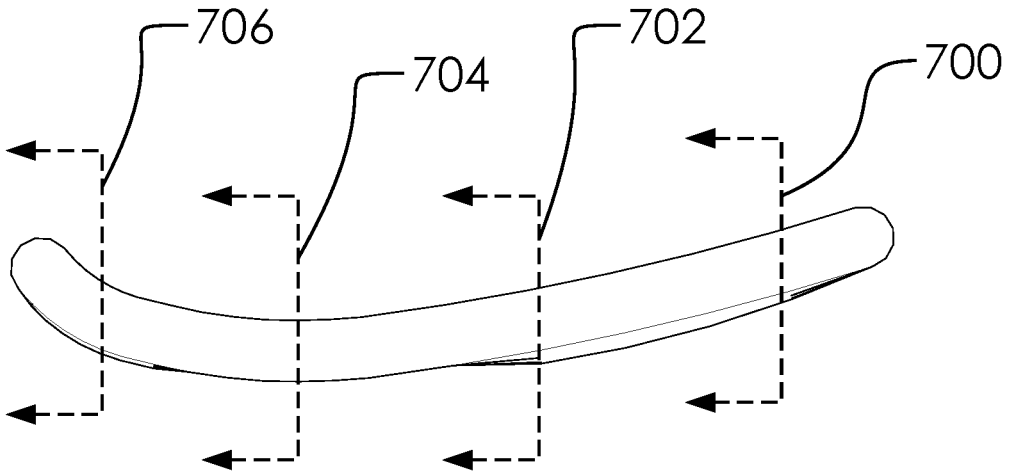
FIGS. 7A, and 7B illustrate an elevated side view and top view of a pivot base 102 showing a first cross-section plane 700, a second cross-section plane 702, a third cross-section plane 704, a fourth cross-section plane 706, and a fifth cross-section plane 708, as illustrated.
Figure 7B:
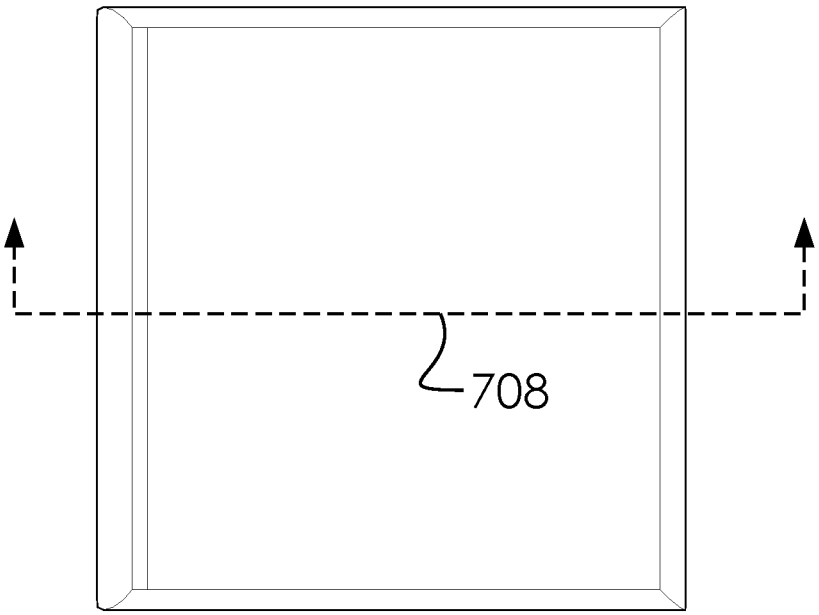
Figure 8A:
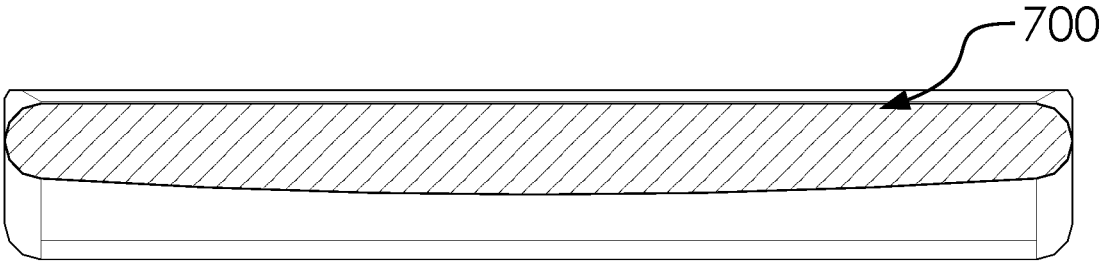
FIGS. 8A, 8B, 8C, and 8D illustrate an elevated front view of said first cross-section plane 700, said second cross-section plane 702, said third cross-section plane 704 and said fourth cross-section plane 706, respectively.
Figure 8B:
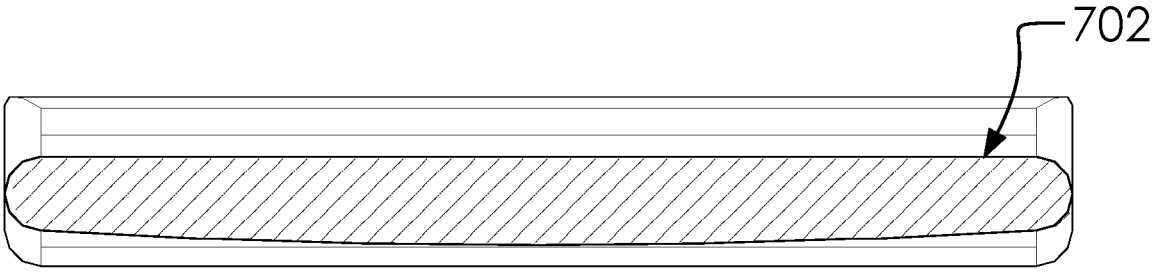
Figure 8C:
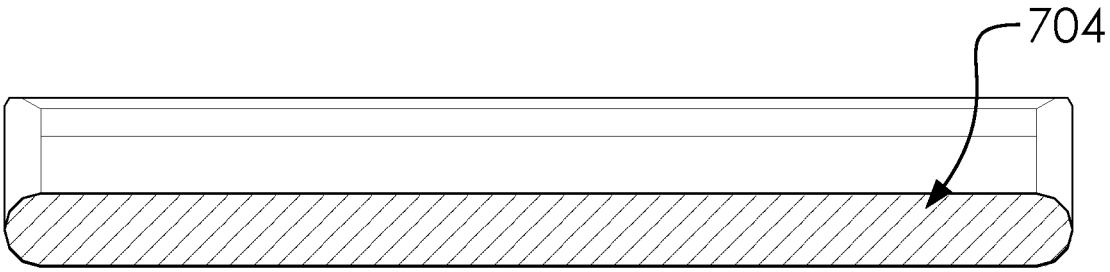
Figure 8D:
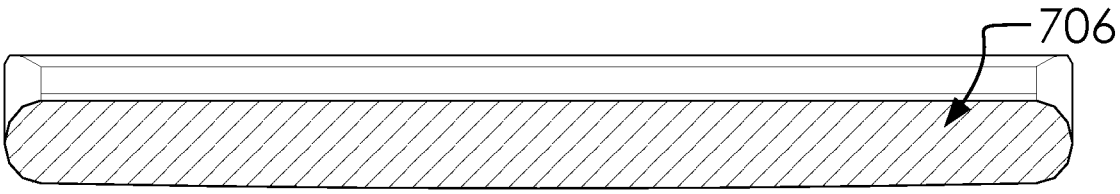

FIGS. 7A, and 7B illustrate an elevated side view and top view of said pivot base 102 showing a first cross-section plane 700, a second cross-section plane 702, a third cross-section plane 704, a fourth cross-section plane 706, and a fifth cross-section plane 708, as illustrated.

FIGS. 8A, 8B, 8C, and 8D illustrate an elevated front view of said first cross-section plane 700, said second cross-section plane 702, said third cross-section plane 704 and said fourth cross-section plane 706, respectively.

Herein, said first cross-section plane 700 and said second cross-section plane 702 illustrate portions of said first convex section 304, said third cross-section plane 704 portions of said central rounded section 302, and said fourth cross-section plane 706 a portion of said second convex section 306.

As shown, said one or more convex sections 308 have a rounded lower surface in cross-section and said one or more non-convex section 310 have a substantially flat lower surface in cross-section view.

Figure 9A:
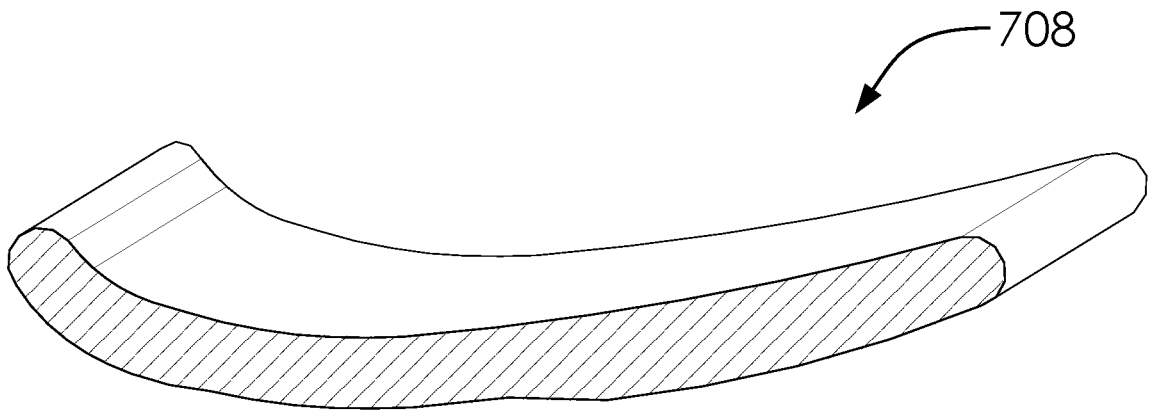
FIGS. 9A, and 9B illustrate an elevated side view of said fifth cross-section plane 708.
Figure 9B:
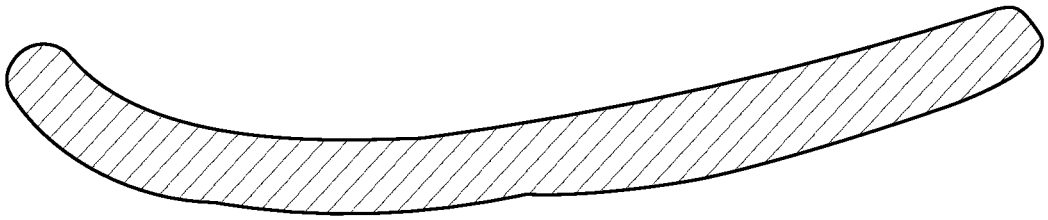

FIGS. 9A, and 9B illustrate an elevated side view of said fifth cross-section plane 708.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

These sentences are included with references to the claims:

Said pivot rocking chair 100 for comfort and rotation through said orientation axis 604 and said horizontal axis of rotation 504. wherein. Said pivot rocking chair 100 comprises said pivot base 102, and said chair portion 104. Said pivot base 102 comprises said front portion 106 and said back portion 108. Said single lower support 112 can be configured to connect to said pivot base 102 with said chair portion 104. Said pivot base 102 comprises said top surface 114, said bottom surface 116, said first side edge 118, and said second side edge 120. Said pivot base 102 comprises said length 402 and said width 400. Said length 402 comprises said forward rocking portion 404 and said rearward rocking portion 406. Said forward rocking portion 404 can be configured to rock on said first convex section 304 and said rearward rocking portion 406 can be configured to rock on said second convex section 306. Said width 400 can be substantially similar to said length 402, thereby said bottom surface 116 can be configured to enable a users to selectively press a chosen portion of said bottom surface 116 into said ground surface 408. Said bottom surface 116 of said pivot base 102 comprises said plurality of pivoting and rocking sections 300, which comprises said central rounded section 302, said first convex section 304, and said second convex section 306. Said plurality of pivoting and rocking sections 300 can be arranged between said front portion 106 and said back portion 108 of said pivot base 102. Said first convex section 304 can be proximate to said front portion 106 and said second convex section 306 can be proximate to said back portion 108. Said pivot base 102 comprises said length 402 and said width 400. Said length 402 comprises said forward rocking portion 404 and said rearward rocking portion 406. Said forward rocking portion 404 can be configured to rock on said first convex section 304 and said rearward rocking portion 406 can be configured to rock on said second convex section 306. Said width 400 can be substantially similar to said length 402, thereby said bottom surface 116 can be configured to enable a users to selectively switch between pivoting and rocking by pressing a chosen portion of said plurality of pivoting and rocking sections 300 into said ground surface 408. Said one or more convex sections 308 have a rounded lower surface in cross-section and said one or more non-convex section 310 have a substantially flat lower surface in cross-section view.

Said pivot rocking chair 100 for comfort and rotation through said orientation axis 604 and said horizontal axis of rotation 504. wherein. Said pivot rocking chair 100 comprises said pivot base 102, and said chair portion 104. Said pivot base 102 comprises said front portion 106 and said back portion 108. Said single lower support 112 can be configured to connect to said pivot base 102 with said chair portion 104. Said pivot base 102 comprises said top surface 114, said bottom surface 116, said first side edge 118, and said second side edge 120.

Said pivot base 102 comprises said length 402 and said width 400. Said length 402 comprises said forward rocking portion 404 and said rearward rocking portion 406. Said forward rocking portion 404 can be configured to rock on said first convex section 304 and said rearward rocking portion 406 can be configured to rock on said second convex section 306. Said width 400 can be substantially similar to said length 402, thereby said bottom surface 116 can be configured to enable a users to selectively press a chosen portion of said bottom surface 116 into said ground surface 408.

Said bottom surface 116 of said pivot base 102 comprises said plurality of pivoting and rocking sections 300, which comprises said central rounded section 302, said first convex section 304, and said second convex section 306. Said plurality of pivoting and rocking sections 300 can be arranged between said front portion 106 and said back portion 108 of said pivot base 102. Said first convex section 304 can be proximate to said front portion 106 and said second convex section 306 can be proximate to said back portion 108.

Said pivot base 102 comprises said length 402 and said width 400. Said length 402 comprises said forward rocking portion 404 and said rearward rocking portion 406. Said forward rocking portion 404 can be configured to rock on said first convex section 304 and said rearward rocking portion 406 can be configured to rock on said second convex section 306.

Said width 400 can be substantially similar to said length 402, thereby said bottom surface 116 can be configured to enable a users to selectively switch between pivoting and rocking by pressing a chosen portion of said plurality of pivoting and rocking sections 300 into said ground surface 408.

Said one or more convex sections 308 have a rounded lower surface in cross-section and said one or more non-convex section 310 have a substantially flat lower surface in cross-section view.

Said pivot rocking chair 100 can be configured to rotate forward and back about said horizontal axis of rotation 504. Said horizontal axis of rotation 504 can be configured to move relative to said pivot rocking chair 100 depending on the shape of said bottom surface 116 as it impacts said ground surface 408. Said pivot rocking chair 100 comprises said full rocking range of motion 508, which comprises a rotary measurement between where said front portion 106 and said back portion 108 can be in contact with said horizontal axis of rotation 504.

Said pivot rocking chair 100 can be configured to rotate forward and back about said horizontal axis of rotation 504. It can be noted that said horizontal axis of rotation 504 can be configured to move relative to said pivot rocking chair 100 depending on the shape of said bottom surface 116 as it impacts said ground surface 408. Said pivot rocking chair 100 comprises said full rocking range of motion 508, which comprises a rotary measurement between where said front portion 106 and said back portion 108 can be in contact with said horizontal axis of rotation 504.

As said pivot rocking chair 100 moves in said rocking motion 506 along said horizontal axis of rotation 504 within said full rocking range of motion 508, portions of said plurality of pivoting and rocking sections 300 can be configured to impact said ground surface 408. At times, portions of said central rounded section 302, said first convex section 304 and/or said second convex section 306 will come into contact with said ground surface 408.

Said one or more convex sections 308 have a rounded lower surface in cross-section and said one or more non-convex section 310 have a substantially flat lower surface in cross-section view.

Said pivot rocking chair 100 for comfort and rotation through said orientation axis 604 and said horizontal axis of rotation 504. wherein. Said pivot rocking chair 100 comprises said pivot base 102, and said chair portion 104. Said pivot base 102 comprises said front portion 106 and said back portion 108. Said single lower support 112 can be configured to connect to said pivot base 102 with said chair portion 104. Said pivot base 102 comprises said top surface 114, said bottom surface 116, said first side edge 118, and said second side edge 120. Said pivot rocking chair 100 can be configured to rotate forward and back about said horizontal axis of rotation 504. It can be noted that said horizontal axis of rotation 504 can be configured to move relative to said pivot rocking chair 100 depending on the shape of said bottom surface 116 as it impacts said ground surface 408. Said pivot rocking chair 100 comprises said full rocking range of motion 508, which comprises a rotary measurement between where said front portion 106 and said back portion 108 can be in contact with said horizontal axis of rotation 504. as said pivot rocking chair 100 moves in said rocking motion 506 along said horizontal axis of rotation 504 within said full rocking range of motion 508, portions of said plurality of pivoting and rocking sections 300 can be configured to impact said ground surface 408. At times, portions of said central rounded section 302, said first convex section 304 and/or said second convex section 306 will come into contact with said ground surface 408.

These parts are used in the specification:

said pivot rocking chair 100,
said pivot base 102,
said chair portion 104,
said front portion 106,
said back portion 108,
said one or more lower support 110,
said single lower support 112,
said top surface 114,
said bottom surface 116,
said first side edge 118,
said second side edge 120,
said plurality of pivoting and rocking sections 300,
said central rounded section 302,
said first convex section 304,
said second convex section 306,
said one or more convex sections 308,
said one or more non-convex section 310,
said width 400,
said length 402,
said forward rocking portion 404,
said rearward rocking portion 406,
said ground surface 408,
said level configuration 500,
said rearward rocking configuration 502,
said horizontal axis of rotation 504,
said rocking motion 506,
said full rocking range of motion 508,
forward rocking range 512,
said forward rocking configuration 516,
said range of pivoted positions 600,
said change of orientation 602,
said orientation axis 604,
said pivoting motion 606,
said first cross-section plane 700,
said second cross-section plane 702,
said third cross-section plane 704,
said fourth cross-section plane 706, and
said fifth cross-section plane 708.

The invention claimed is:

1. A pivot rocking chair for comfort and rotation through an orientation axis and a horizontal axis of rotation; wherein:

said pivot rocking chair comprises a pivot base, and a chair portion;

said pivot base comprises a front portion, a back portion, a length and a width;

a single lower support is configured to connect to said pivot base with said chair portion;

said pivot base comprises a top surface, a bottom surface, a first side edge, and a second side edge;

said plurality of pivoting and rocking sections are arranged between said front portion and said back portion of said pivot base;

said plurality of pivoting and rocking sections comprise one or more convex sections and one or more non-convex sections;

said one or more non-convex sections comprise a central rounded section;

said one or more convex sections have a rounded lower surface in cross-section and said one or more non-convex sections have a substantially flat lower surface in cross-section view;

with said bottom surface contacting a ground surface with said one or more convex sections, said pivot rocking chair is configured to move in a pivoting motion about said orientation axis;

said orientation axis comprises a substantially vertical axis above a place where a portion of a convex surface is in contact with contact with said ground surface;

with said bottom surface contacting said ground surface with said one or more non-convex sections, said pivot rocking chair moves in a rocking motion along said horizontal axis of rotation inline with said front portion and said back portion of said pivot rocking chair;

said plurality of pivoting and rocking sections of said bottom surface are configured to enable a users to selectively switch between pivoting and rocking by pressing a chosen portion of said plurality of pivoting and rocking sections into said ground surface.

2. The pivot rocking chair of claim 1, wherein:

said pivot base comprises a forward rocking portion and a rearward rocking portion;

said one or more convex sections comprise a first convex section and a second convex section;

said forward rocking portion is configured to rock on said first convex section and said rearward rocking portion is configured to rock on second convex section; and said plurality of pivoting and rocking sections comprises said central rounded section, said first convex section, and said second convex section.

3. The pivot rocking chair of claim 1, wherein:

said bottom surface of said pivot base comprises said plurality of pivoting and rocking sections, which comprises said central rounded section, said first convex section, and said second convex section;

said plurality of pivoting and rocking sections are arranged between said front portion and said back portion of said pivot base; and said first convex section is proximate to said front portion and said second convex section is proximate to said back portion.

4. The pivot rocking chair of claim 3, wherein:

said length of said pivot base comprises said forward rocking portion and said rearward rocking portion; and said forward rocking portion is configured to rock on said first convex section and said rearward rocking portion is configured to rock on said second convex section.

5. The pivot rocking chair of claim 4, wherein:

said width is substantially similar to said length.

6. The pivot rocking chair of claim 5, wherein:

said pivot rocking chair is configured to rotate forward and back about said horizontal axis of rotation;

said horizontal axis of rotation is configured to move relative to said pivot rocking chair depending on the shape of said bottom surface as it impacts said ground surface; and said pivot rocking chair comprises a full rocking range of motion, which comprises a rotary measurement between where said front portion and said back portion are in contact with said horizontal axis of rotation.

7. The pivot rocking chair of claim 1, wherein:

said pivot rocking chair is configured to rotate forward and back about said horizontal axis of rotation;

said horizontal axis of rotation is configured to move relative to said pivot rocking chair depending on the shape of said bottom surface as it impacts said ground surface; and said pivot rocking chair comprises said full rocking range of motion, which comprises a rotary measurement between where said front portion and said back portion are in contact with said horizontal axis of rotation.

8. The pivot rocking chair of claim 1, wherein:

as said pivot rocking chair moves in said rocking motion along said horizontal axis of rotation within said full rocking range of motion, portions of said plurality of pivoting and rocking sections is configured to impact said ground surface; and at times, portions of said central rounded section, said first convex section and/or said second convex section will come into contact with said ground surface.

9. The pivot rocking chair of claim 1, wherein:

said one or more non-convex sections comprise said central rounded section.

* * * * *